United States Patent [19]

Rommelfaenger et al.

[11] Patent Number: 4,964,193

[45] Date of Patent: Oct. 23, 1990

[54] HINGE

[75] Inventors: Peter R. Rommelfaenger; Thomas A. Neuwirth, both of Milwaukee, Wis.

[73] Assignee: E. R. Wagner Manufacturing Company, Milwaukee, Wis.

[21] Appl. No.: 40,881

[22] Filed: Apr. 21, 1987

[51] Int. Cl.[5] ..... E05D 5/10; E05D 11/08

[52] U.S. Cl. ..... 16/225; 16/273; 16/342; 16/386; 16/385

[58] Field of Search ..... 16/228, 225, 273, 385, 16/386, DIG. 13, 308, 337, 342, 338

[56] References Cited

U.S. PATENT DOCUMENTS 4,256,388 3/1981 Beyer ..... 16/385

4,630,333 12/1986 Vickers ..... 16/386

*Primary Examiner*—Richard K. Seidel

*Assistant Examiner*—Edward A. Brown

*Attorney, Agent, or Firm*—Bayard H. Michael

[57] ABSTRACT

The hinge has two leaves with interengaging knuckles. A plastic coated metal hinge pin extends through the knuckles and the knuckles are crimped onto the plastic coated hinge pin. The tighter the knuckles grip the pin the more the plastic is deformed and the greater will be the torque required to operate the hinge. The plastic is extruded onto the pin to bond the plastic to the pin.

2 Claims, 1 Drawing Sheet

HINGE

BACKGROUND OF THE INVENTION

There are many situations where it is desirable to have the cover or lid of a box, trunk or the like stay open without risk of the lid falling rapidly down on the user's head, hand or what have you. The usual solution is to provide a torsion spring, but a torsion spring is costly and is not very attractive.

The principle object of this invention is to provide an alternative construction providing considerable advantages over a torsion hinge.

SUMMARY OF THE INVENTION

We provide a hinge of the type having first and second leaves which have integrally formed knuckles or barrels. The knuckles of one leaf fit between the knuckles of the other leaf. The barrels are formed around a hinge pin which is provided with a plastic coating into which the barrels are pressed in the manufacturing operation. The barrels are pressed into engagement with the plastic coating with a force which determines the operating characteristic of the hinge.

When the barrels are pressed into the plastic with force sufficient to permanently displace or compress the plastic, there is a frictional resistance to movement of the hinge. This frictional resistance can be tailored to provide the desired resistance all the way from very little resistance to substantial resistance. The barrels can be formed so as to impose hardly any resistance to movement and in that case, the coating on the hinge pin provides a lubricating quality and protects the hinge pin from corrosion and from developing squeaks.

The resulting hinge has outstanding operating characteristics in either of its two general modes, i.e., as a friction hinge or as a corrosion resistant hinge.

DETAILED DESCRIPTION OF THE DRAWINGS

Figure 1:
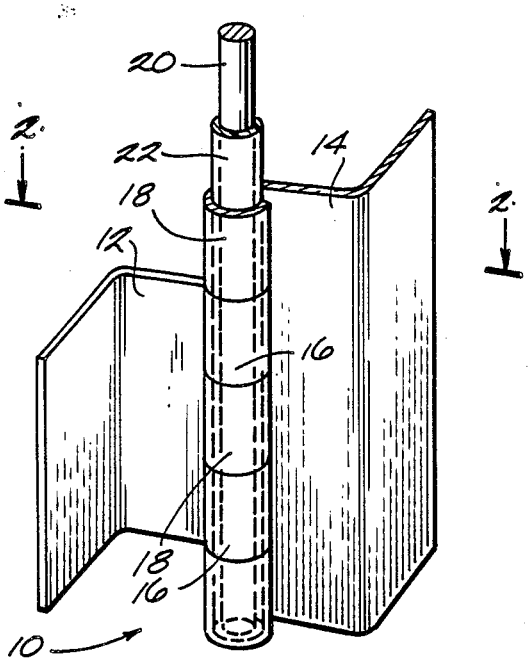
FIG. 1 is a perspective view of a hinge with part of a leaf broken away and with part of the plastic coating broken away.
Figure 2:
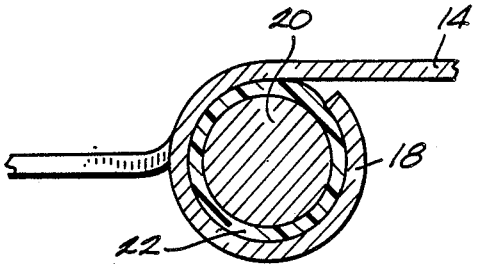
FIG. 2 is an enlarged section taken on line 2—2 in FIG. 1.

The drawing shows one type of hinge, but the invention can be applied to many types of continuous hinges. In FIG. 1 hinge 10 has two steel leaves 12, 14 with knuckles or barrels 16, 18 formed to interengage alternately. The steel hinge pin 20 has a plastic coating 22 The plastic is extruded onto the pin thick enough to be deformed as the barrels are subsequently squeezed/-formed over the coated pin. The plastic is bonded to the pin If the barrel grips the pin slightly, the hinge movement has a luxurious, silky feel to it. The barrels can be squeezed or formed onto the coated pin so the plastic is deformed appreciably and the barrels grip the coated pin rather tightly. This develops considerable resistance to moving the hinge and the hinge can be left open without fear of rapidly self-closing. The torque required to open/close the hinge is determined by the degree of compression of the plastic. Thus, for example, the hinge can be applied to the lid on a center console between the seats in an automobile and the lid can be raised without fear that it will fall and hit your fingers as you are looking for a tape. The hinge can, also, be applied to a glovebox or the ashtray of an automobile.

The plastic coating can be any suitable material, but one which has worked well is HYTREL 7246 polyester elastomer made by DuPont to which HYTREL G-30HS heat stabilizer has been added (approximately 20%). This results in a moisture proof plastic which retains its functional characteristics up to 320° F. and improves the useful life at normal temperatures. The plastic can easily withstand the temperature required to bake a painted hinge.

The hinges are made by a continuous Process. The wire which comes wound on a drum is first straightened to remove camber from the wire. After straightening, the wire goes through a pipe which is heated to warm the wire prior to the wire entering an extruder crosshead. In the extruder crosshead plastic which has been heated to a viscous state is melted and flowed onto the wire at a rate matched to the speed of the wire moving through the crosshead to obtain the desired thickness. As the plastic coated wire exits the crosshead, it immediately passes through a continuous stream of cold water which solidifies and sizes the plastic around the wire. The plastic firmly grips the pin with no hint of relative movement Then the coated wire is pulled through a water trough to bring the co-extrusion down to ambient temperature. The coated wire is then wound onto a drum or is immediately fed into a continuous hinge making process. In the hinge making process, the coated wire and leaf material move through the process uninterruptedly. The hinge leaves are brought together in this process with the wire positioned to be engaged by the knuckles or barrels as they are formed. All of this takes place on a continuous basis.

When crimping the barrels onto the coated pin, the barrels must be moved slightly beyond their relaxed position, that is, they will dig deeper into the plastic momentarily, but when the forming force is removed from the barrels, they will move back a little bit while still retaining engagement with the plastic to an extent determined by the crimping force closing the barrels in the first place. After the continuous hinge has been formed, the hinges are cut to length, and finished (plated or painted) if required.

HYTREL 7246 polyester elastomer has high load bearing capacity and good resistance to creep. The elastomer remains flexible at low temperatures and, as noted above, the addition of the heat stabilizers can extend the upper useful range to 320° F. while at the same time improving the useful life at lower temperatures.

One hinge made this way has a steel pin diameter of 0.164" and the coated pin diameter is 0.200" which means the coating is 0.018" thick. It is estimated the knuckle is crimped into the plastic about 0.01" but it then springs back a bit. The hinge has appreciable resistance to movement.

With the formation of the barrels in this manner to grip the plastic coating, sufficient force is developed to hold the pin in the hinge without the necessity for bending or otherwise forming the end of the pin to prevent loss of the pin. It is not necessary to lubricate the pin because the coated pin has natural lubricity in this environment.

Prior art hinges end up getting noisy and squeaky. This is because the painted prior art hinges eventually wear out the paint and this results in rust and the rust causes squeaking. The present coated pin protects the pin from wear and the barrel gripping the pin is, in effect, not exposed to oxidation, so rust is no problem. The rust in the Prior art also caused uncontrolled binding and the Present hinge is not afflicted with this.

The present coated pin has great advantage over a solid plastic pin material since solid plastic material does not force the barrels to remain concentric with the pin. The present construction with the solid steel pin has the effect of providing a steel skeleton inside the relatively soft plastic coating. This retards or eliminates the tendency of the knuckles or barrels to move eccentric of the center line of the pin. The hinge remains rigid during its life because of the skeletal steel pin inside the plastic coating. The plastic will yield to allow the hinge movement, but the plastic displays the strength of the material it encases.

This hinge provides a superior feel to the parts associated with the hinge. The feel is luxurious or "quality". The hinge offers easy operation or inhibited operation. The hinge will last longer than normal hinges The hinge performs better in hostile environments. The hinge has outstanding life.

We claim:

1. A hinge comprising, first and second leaves having interengaging formed barrels with aligned apertures through the barrels, a hinge pin, a plastic coating bonded on the pin, said hinge pin being mounted in said apertures and said barrels being crimped onto the hinge pin to engage and radially compress said plastic coating, said plastic coating having a self-lubricating characteristic when lightly compressed and gripped by said barrels and developing increasing resistance to hinge operation as the barrels compress and grip said coating with increasing force.

2. A hinge comprising, first and second leaves having interengaging knuckles, a metal hinge pin extending through said knuckles, a plastic coating bonded on said hinge pin, said knuckles being crimped into said coated hinge pin to compress and grip the plastic with the degree of compression of the plastic determining the torque required to operate the hinge.

* * * * *